US005417288A

United States Patent [19]

Melenyzer et al.

[11] Patent Number: 5,417,288

[45] Date of Patent: May 23, 1995

[54] HYDRAULIC SET LINER HANGER AND METHOD

[75] Inventors: George J. Melenyzer, Humble; Janice Norris, Spring; George Givens, Houston, all of Tex.

[73] Assignee: Baker Hughes, Inc., Houston, Tex.

[21] Appl. No.: 265,195

[22] Filed: Jun. 24, 1994

[51] Int. Cl.[6] ..... E21B 23/02

[52] U.S. Cl. ..... 166/382; 166/383; 166/208; 166/212

[58] Field of Search ..... 166/382, 383, 208, 217, 166/212

[56] References Cited

U.S. PATENT DOCUMENTS

| | | | |
|---|---|---|---|
| 4,060,131 | 11/1977 | Kenneday et al. . | |
| 4,096,913 | 6/1978 | Kenneday et al. . | |
| 4,141,413 | 2/1979 | Morris et al. | 166/212 X |
| 4,523,641 | 6/1985 | Manderscheid . | |
| 4,580,631 | 4/1986 | Baugh | 166/208 |
| 4,688,642 | 8/1987 | Baker | 166/382 |
| 4,732,212 | 3/1988 | Fraser, III | 166/382 X |
| 4,825,954 | 5/1989 | Baugh . | |
| 4,828,037 | 5/1989 | Lindsey et al. | 166/386 X |
| 4,842,069 | 6/1989 | Baugh et al. . | |
| 4,862,966 | 9/1989 | Lindsey et al. | 166/208 X |
| 4,911,237 | 3/1990 | Melenyzer . | |
| 4,926,936 | 5/1990 | Braddick | 166/217 |
| 4,926,938 | 5/1990 | Lindsey, Jr. | 166/217 X |
| 4,942,924 | 7/1990 | Dunean | 166/208 X |
| 5,038,860 | 8/1991 | Baugh et al. . | |
| 5,052,488 | 10/1991 | Fraser, III . | |
| 5,086,845 | 2/1992 | Baugh . | |
| 5,309,621 | 5/1994 | O'Donnell et al. . | |
| 5,318,131 | 6/1994 | Baker | 166/382 |

*Primary Examiner*—Ramon S. Britts
*Assistant Examiner*—Frank S. Tsay
*Attorney, Agent, or Firm*—Browning, Buchman, Anderson & Brookhart

[57] ABSTRACT

A liner hanger assembly structurally interconnects a casing within a bore hole and a tubular liner suspended from the casing. The hanger body includes a plurality of circumferentially spaced piston bores. A plurality of slips are provided circumferentially about, the hanger body for gripping engagement with an internal surface of the casing. A plurality of pistons are each housed within a respective piston bore and are movably responsive to internal pressure within the hanger body. A sleeve is axially movable with respect to the hanger body in response to axial movement of the plurality of pistons. The sleeve is interconnected with each of the plurality of slips to cause radially outward movement of the slips in response to movement of the pistons. The liner hanger assembly has a high fluid pressure rating for ensuring reliable gripping engagement with the casing, yet creates a comparatively low fluid restriction in the annulus between the casing and the liner.

20 Claims, 2 Drawing Sheets

HYDRAULIC SET LINER HANGER AND METHOD

FIELD OF THE INVENTION

The present invention relates to liner hangers of the type used for structurally interconnecting a large diameter oilfield casing with a smaller diameter oilfield liner. More particularly, the invention is directed to a liner hanger that is configured to obtain a high internal pressure rating while creating a comparatively low flow restriction in the annulus between the casing and the liner. The liner hanger has utility in various hydrocarbon recovery operations.

BACKGROUND OF THE INVENTION

Liner hangers have long been used in petroleum recovery operations to structurally interconnect a lower end of a large diameter tubular, such as a casing string, to a comparatively smaller diameter tubular, such as a liner. In a typical application, the casing string is cemented in place in the well bore, and the well operator seeks to suspend a smaller diameter liner concentrically within the well bore from the lower end of the casing string.

A liner may be run into the well bore from a work string, and the liner then structurally interconnected with the lower end of the casing string by a liner hanger. In a typical application, cement or another fluid may be subsequently pumped downhole through the structurally interconnected liner. Fluid may thereafter be forced upward in the annulus between the liner and the well bore. Accordingly, the liner hanger, which is structurally spaced in the annulus between the lower end of the casing and upper end of the liner, creates a restriction to this upward flow of cement or other fluid.

While various mechanisms have been used to set a liner hanger for structurally interconnection with a casing, hydraulically set liners have a significant advantage over other types of hanger setting mechanisms. Conventional liner hangers thus include a sleeve-shaped piston that moves axially with respect to the liner hanger body. In a typical application, the fluid pressure within the well bore and thus within the liner hanger body may be selectively increased until the hydraulic force supplied to the sleeve-shaped piston shears a pin, which then allows the piston to move axially to the enable camming surfaces to force the slips on the liner hanger into biting engagement with the casing.

Those skilled in the art of designing liner hangers recognize that, in many applications, the annulus between the casing and the liner may be relatively thin. The radial thickness of the liner hanger body that houses the sleeve-shaped piston accordingly is limited. An increase in the thickness of the liner hanger body is desirable in order to obtain a high pressure rating for the liner hanger, thereby allowing a higher biting force to be applied between the slips and the casing without risking rupture of the liner hanger. On the other hand, a decrease in the radial thickness of the liner hanger body is desired to minimize the flow restriction in the annulus between the casing and the liner. Accordingly, the design of prior art liner hangers has involved a balancing of an acceptable flow restriction created by the liner hanger with a desired maximum pressure rating for the liner hanger.

Another problem with many types of liner hangers is that the slips are not structurally prevented from prematurely moving radially outward. In most applications, this is not a problem since a force is not generated that would cause outward movement of the slips before the fluid pressure was intentionally increased to set the liner hanger, as explained above. In some applications, however, it is desirable to rotate the work string and thus the liner hanger while lowering the liner within a deviated well. This rotation of the liner and the hanger creates a centrifugal force that tends to force the slips radially outward before intentionally setting the liner hanger. This premature radially outward movement of the slips dulls the slip teeth due to the rotating engagement of the slip teeth with the casing. A few prior art liner hangers do, however, effectively prevent this premature radial outward movement of the hanger slips.

The disadvantages of the prior art are overcome by the present invention, and improved techniques are hereinafter disclosed for forming a hydraulically set liner hanger, and for structurally interconnecting a liner hanger with a casing. According to this invention the liner hanger may obtain a high pressure rating while still minimizing the flow restriction created by the liner hanger.

SUMMARY OF THE INVENTION

One embodiment of a liner hanger assembly includes a unitary body having upper threads for interconnection with a connector of the lower end of a work string, and lower threads for interconnection with a liner. The body preferably has a substantially uniform diameter bore for communication with the bore in the liner, so that the hanger body does not significantly restrict the flow of fluids (or tools) into the bore of the liner.

A plurality of slips are circumferentially positioned uniformly about the hanger body. In the circumferential spacing between adjacent slips, the outer surface of the hanger body is recessed, thereby creating a plurality of flow paths exterior of the set liner hanger body between the circumferentially spaced slips. The slips are moved outward into engagement with the casing by a plurality of slip actuators, which may comprise a plurality of pistons each housed within the hanger body at a location axially spaced from the slips and circumferentially spaced between the body recesses. A radially thick portion of the hanger body includes a pair of cylindrical holes each angled with respect to the central axis of the hanger body. A corresponding pair of pistons are each sealingly movable within a cylindrical hole within the body in response to fluid pressure internal of the hanger body. The upper end of each piston engages a shear sleeve when fluid pressure is increased. Axial movement of the shear sleeve forces each of the plurality of slips radially outward into biting engagement with the casing. Until the shear sleeve moves axially in response to the movement of the plurality of pistons, the slips are prevented from moving radially outward by the structural interconnection of ears on the side of each slip and the walls of a corresponding slot in the hanger body.

It is an object of the invention to provide an improved hydraulic liner hanger assembly that has both a high fluid pressure rating and a low fluid flow restriction.

Another object of the invention is a hydraulic liner hanger assembly that utilizes a plurality of fluid pressure responsive pistons each housed within the hanger body to axially move a sleeve and thereby cause outward movement of each of a plurality of slips. Each of the fluid pressure responsive pistons is provided within a respective cylindrical bore having a substantially uniform diameter within the hanger body in order to minimize manufacturing cost for the assembly.

It is a feature of the invention that the hanger body has a plurality of circumferentially spaced recesses radially outward from the hanger body. Each recess is spaced between respective circumferentially spaced slips for minimizing the flow restriction created by the set hanger assembly.

Another feature of the invention is that each of the plurality of cylindrical bores within the hanger body for receiving a respective piston may be angled with respect to the central axis of the hanger body to increase the fluid pressure rating of the hanger assembly.

Yet another feature of this invention is that guide members are provided on the hanger body for cooperating with each of the plurality of slips to prevent the slips from prematurely moving radially outward.

A significant advantage of the assembly according to this invention is that the pressure rating of the liner hanger assembly may be significantly increased without significantly increasing the cost of the assembly, without increasing the fluid flow restriction created by the assembly, and without adversely affecting the reliability of the hanger setting operation.

These and further objects, features, and advantages of the present invention will become apparent from the following detailed description, wherein reference is made to the figures in the accompanying drawing.

DETAIL DESCRIPTION OF PREFERRED EMBODIMENTS

Figure 1:
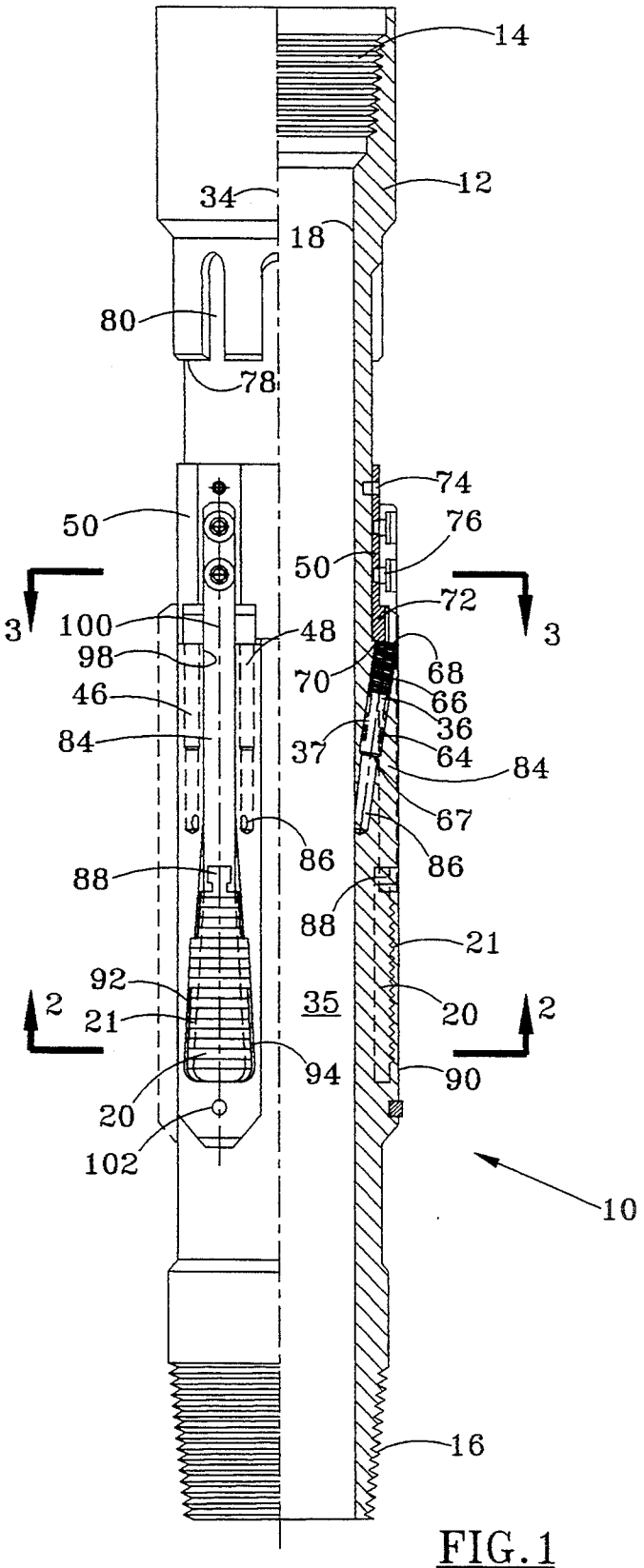
FIG. 1 is a half-sectional view of one embodiment of a liner hanger assembly according to the present invention.

FIG. 1 is a half-sectional view of a suitable liner hanger assembly 10 according to the present invention. The liner hanger assembly may be used to structurally interconnect first and second downhole tubulars of different diameters within a well bore, and more particularly for structurally suspending a second downhole tubular from the lower end of a larger-diameter first tubular. The liner hanger assembly of this invention has various applications, and a suitable application is described herein. The liner hanger assembly may be run into a well bore having a casing (a first tubular) already cemented in place. The assembly 10 may be suspended from a tubular work string, with a liner (a second tubular) connected to the assembly 10. Once the liner hanger assembly has been positioned in the well bore as explained hereafter, the hanger assembly 10 may be structurally fixed to casing, so that the smaller diameter liner will be structurally suspended in the well bore from the hanger assembly, which in turn is fixed to the lower end of the casing. Those skilled in the art will appreciate that the suspended liner may subsequently be structurally fixed within the well bore by cementing the liner in place, in which case the hanger assembly 10 serves the purpose of suspending the liner within the well bore prior to the liner cementing operation.

The liner hanger assembly 10 includes a unitary body 12 that has upper threads 14 form thereon for structural interconnection with a suitable connector (not shown), which connector may be suspended from the end of the work string (not shown). The lower end of the body 12 has similar threads 16 for structurally interconnecting the body 12 with a liner (not shown) or other second tubular member. Those skilled in the art will appreciate that threads such as 14 and 16 are commonly used to interconnect liner hangers with work strings or with tubulars suspended from the hanger assembly. Any type of structural connection may be employed, however, for interconnecting the body 12 with either the work string or the liner. The body 12 includes a comparatively large diameter central through bore defined by uniform diameter interior surface 18 of the body, which provides substantially full bore communication between the well bore above the hanger assembly and the interior of the liner suspended from the hanger assembly.

The liner hanger assembly 10 as shown in FIG. 1 is of the type that includes circumferentially spaced slips uniformly positioned about the circumference of the body 12. One of the slips 20 is pictorially shown in FIG. 1. Those skilled in the art will appreciate that three such slips may be provided, each circumferentially spaced 120° about the body 12. Each of the slips include rows of teeth 21 that are provided for biting engagement with the interior surface of the casing. Actuation of the assembly 10 to the set position, as explained subsequently, causes each of the slips to move radially outward with respect to the body 12, so that the slips grippingly engage the casing and thereby fix the position of the assembly 10 within the well bore, and thus fix the liner in the well bore suspended from the assembly 10.

Figure 2:
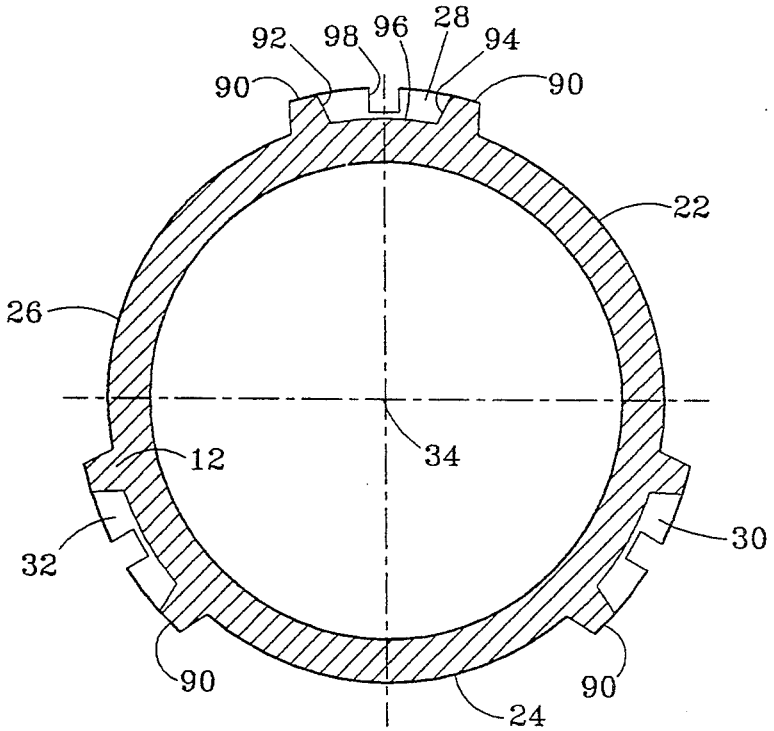
FIG. 2 is a cross-sectional view taken along lines 2—2 in FIG. 1.

FIG. 2 illustrates a significant feature of the present invention that results in a hanger assembly body 12 having a comparatively high pressure rating and a comparatively low flow restriction for fluid passing in the annulus between the casing and the liner. The portions of the unitary body 12 in the vicinity of the plurality of slips 20 have an outer surface 90 formed by arcs of a circle having its center along central axis 34 of the assembly. A pocket as shown in FIG. 2 is formed within each of these arcs for receiving a respective slip, as discussed subsequently. The outer surface of the body is substantially recessed in the circumferential spacing between these slips, thereby creating recessed outer surfaces 22, 24 and 26. Each of these recessed outer surfaces is also an arcuate surface having a center along central axis 34. Each of the recessed outer surfaces 22, 24 and 26 provides a substantial flow area for fluids between the exterior surface of the body 12 and the interior surface of the casing. Accordingly, the recessed surfaces 22, 24 and 26 significantly reduce the fluid flow restriction of the assembly 10 compared to prior art liner hanger assemblies with a uniform diameter outer surface.

According to the present invention, the radial thickness of the body 12 (the radial spacing between surfaces 18 and 22) inward of each recess is significantly less than the radial thickness of the body 12 (the radial spacing between surfaces 18 and 90) which houses each of the slips. To provide for the desired cross-sectional fluid flow path past the assembly 10, the radial thickness of the body adjacent each fluid flow recess may be less than 70%, and preferably less than about 55%, the thickness of the hanger body adjacent each respective slip. The thickness of the recess must be controlled in order to provide the desired integrity for the body to withstand high internal fluid pressure and prevent bursting of the hanger body. In many applications, the relatively thin annulus between the casing and the hanger body will not allow the thickness of the hanger body adjacent each recess to be less than 40% of the full thickness of the body surrounding a respective slip.

Still referring to FIG. 2, a pocket having a generally quadrilateral shape with slated sides is provided in the full diameter portion of body 12 for receiving a respective slip 20. Accordingly, three such pockets 28, 30 and 32 are shown in FIG. 2 for receiving three respective slips 20. Each pocket has a tapered side wall 92 and 94, and a pocket base surface 96. Tapered side walls 92 and 94 are also depicted in FIG. 1. Those skilled in the art will appreciate that the inclined surfaces 92 and 94 act as camming surfaces to force the slips radially outward as the slips move axially along these surfaces. Such camming action is conventional in prior art downhole equipment with slips, and accordingly is not discussed in detail below. The pocket base surface 96 is sufficiently deep so that, prior to actuation of the liner hanger assembly, the teeth 21 of each slip 20, as shown in FIG. 1, do not extend radially outward of the surface 90.

Figure 3:
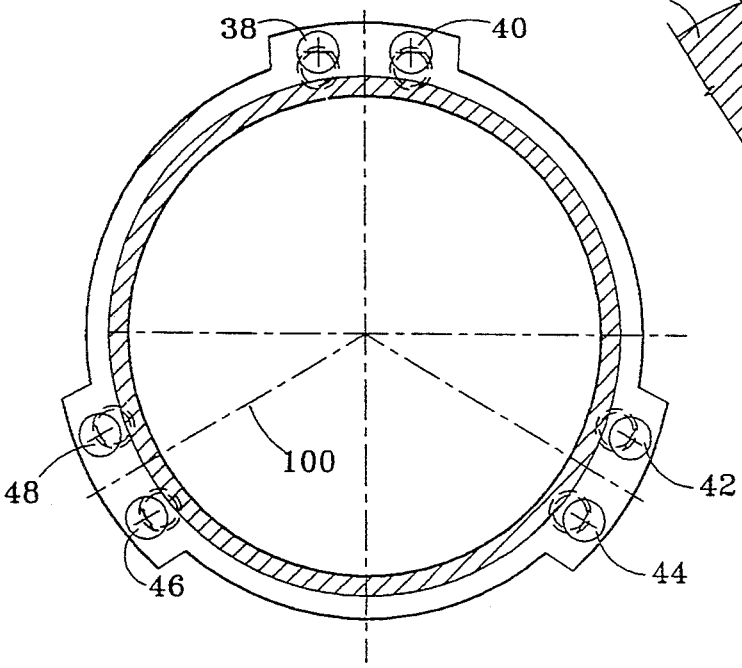
FIG. 3 is a cross-sectional view taken along lines 3—3 in FIG. 1.

Referring again to FIG. 1, each of the circumferentially spaced pistons 36 is housed within the body 12. Each piston 36 is preferably spaced axially from the slips 20, and is positioned within the full diameter portion of the body 12 at a circumferential position substantially aligned with one of the slips 20. For the depicted embodiment, two such pistons 36 are provided for each of the three slips. FIG. 3 accordingly depicts six piston holes 38, 40, 42, 44, 46 and 48 within the body 12. Each hole is provided for receiving a respective piston 36. As shown in FIGS. 1 and 3, the depicted slip 20 has a slip centerline 100, and the two piston holes 46 and 48 are spaced on opposite sides of the centerline 100 but are each still generally aligned circumferentially with the slip 20 and are positioned within the full diameter portion of the body 12.

Each fluid powered piston 36 includes a portion 37 with a circular cross-sectional configuration, and carries a sealing assembly 64 thereon. Assembly 64 may consist of any suitable seal for dynamic sealing engagement with the cylindrical sealing surface of each piston bore. A suitable sealing assembly includes one or more elastometric O-rings and backup rings. Piston *36* is powered by providing fluid communication between the interior flow path 35 within the body 12 and each piston bore, so that fluid pressure acts on the fluid pressure face 67 of each piston 36. The opposing end surface 68 on the piston transmits force to the sleeve 50. The outer surface of the piston between the seal 64 and the surface 67 preferably includes a spiraling thread or other discontinuous (non-cylindrical) surface for preventing fluid adjacent the piston and downstream from the seal from being trapped within the body 12. Accordingly, fluid pressure exterior of the assembly 10 exists on one side of the seal assembly 64, while fluid pressure within the assembly 10 acts on the opposing side of the seal 64.

Figure 5:
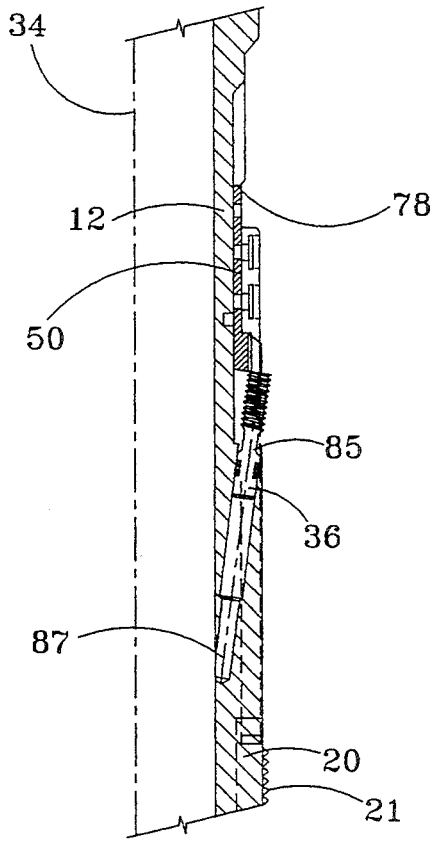
FIG. 5 is a cross-sectional view of a portion of the liner hanger assembly shown in FIG. 1, with the piston and the slip illustrated in their set position.

FIG. 1 depicts sleeve 50 that is axially movable relative to body 12 and is shown in its unset position. FIG. 5 depicts the same sleeve 50 shifted axially to its set position. Lower end 72 of the sleeve 50 includes a piston engaging surface 70. Upward movement of the sleeve 50 with respect to the body 12 is limited by the stop surface 78 provided on the body 12. As the sleeve 50 moves upward, fluid between the sleeve 50 and the stop surface 78 may freely move to the annulus between the body 12 and the casing, or may flow into the recessed channels 80 provided within the body 12. FIG. 5 accordingly depicts the sleeve 50 in its set position, with the sleeve 50 in engagement with the stop surface 78. In order for the sleeve 50 to move axially with respect to the body 12, the force provided by the plurality of pistons 36 must first shear the pin 74 that interconnects the sleeve 50 and the body 12, thereby preventing axial movement of the sleeve 50 until the pressure within the interior of the assembly 10 has been increased to a preselected level.

Sleeve 50 is structurally interconnected with a plurality of elongate straps 84 by securing members 76. Straps 84 in turn structurally interconnect the sleeve 50 and a respective one of the plurality of slips 20. A T-head connection 88 is provided between the lower end of each strap and each of the respective slips, thereby allowing each slip to pivot slightly with respect to the strap and move radially outward into engagement with the casing. Each of the straps 84 thus slide within a respective groove 98 formed in the outer surface of the body 12.

As shown in FIG. 1, each of the piston bores has a substantially cylindrical sealing surface that, compared to other bore configurations, significantly reduces the cost of forming each piston bore within the body 12. Each piston bore is preferably formed about a piston bore axis 85 that, as shown in FIG. 1, is angled slightly with respect to the centerline 34 of the body 12. The slight inclination of the piston bore axis 85 facilitates formation of the bore within the body by a conventional drilling and boring operation. Also, it is believed that by angling the axis 85 relative to the axis 34, the structural integrity of the body 12 is enhanced compared to a design wherein the piston bore axis is parallel to the body axis 34. A fluid passageway 86 is provided for providing fluid communication between the interior of the body 12 and the face 67 of each piston, and this fluid passageway preferably is formed along an inclined axis 87 that, like axis 85, may be formed in the body 12 by a conventional machining operation.

Figure 4:
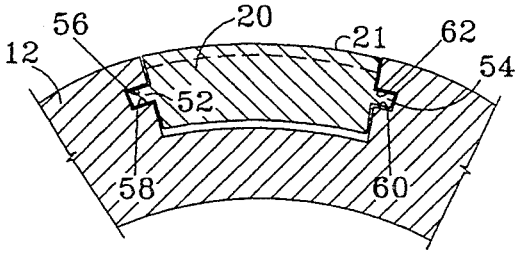
FIG. 4 is a cross-sectional view illustrating the movable guide surfaces on the liner hanger body for preventing a slip from prematurely moving radially outward.

FIG. 4 depicts a portion of the assembly 10 discussed above, and more particularly illustrates a suitable guide mechanism for preventing the slip 20 from moving radially outward until the shear pin 74 has been severed. Each of the slips 20 may be provided with a pair of projecting ears 52 and 54 that each fit within a corresponding slot in the body 12. The slot for ear 52 is formed by sidewalls 56 and 58 in the body 12, while the corresponding slot for ear 54 is formed by side walls 60 and 62 in the body 12. These slots within the body extend along substantially the axial length of the camming surfaces 92 and 94 on the body that force the slips radially outward. More particularly, the guide surfaces 56 and 62 on the body prevent each slip from moving radially outward prematurely. The inclination of the slots within the body enables the slips to move outward as the slips move axially with the sleeve 50 toward stop surface 78. A similar technique has been used in selected prior art hanger assemblies for preventing unintended radial outward movement of the hanger slips.

The operation of the tool may be briefly described as follows. It may be presumed that a casing is already cemented in a well bore, and that the operator desires to suspend a liner from the well bore and then cement the liner in place. The liner may be suspended from the lower end of the assembly 10 as shown in FIG. 1, and the upper end of the assembly 10 may be connected to a work string for lowering the assembly 10 in place. While the assembly is lowered in place, it may be desirable to rotate the work string and thus the assembly 10 and the liner. This rotation is particularly desirable when attempting to force the liner into a highly deviated or horizontal bore hole. Since the work string is rotated, a centrifugal force is created that tends to force each of the slips radially outward into engagement with the casing. This radial movement is prevented, however, by the guide surfaces that interconnect each slip with the body 12, as shown in FIG. 4. To reduce wear on the outer surface 90 of the body 12, a plurality of circumferentially spaced and axially spaced carbide insert buttons 102 may be pressed into cylindrical recesses in the body 12. Only two such buttons 102 are illustrated in FIG. 1, although additional buttons preferably would be provided both above and below each of the slips. By minimizing wear on the outer surface 90 of the body 12, the teeth 21 of the slips are prevented from wearing during this rotation.

Once the assembly 10 is properly positioned in the well bore at its desired location with respect to the casing, the pressure within the well bore, and thus within the interior of the body 12, may be increased, thereby increasing the upward force being transmitted to the sleeve 50 by the plurality of the pistons 36. Once this interior pressure has reached a predetermined value, the shear pin 74 will be severed, thereby allowing the sleeve 50 to move radially upward toward the stop surface 78. In order to obtain a reliable engagement of the assembly 10 and the casing, interior fluid pressure may thereafter be significantly increased since, as previously noted, the unitary body 12 is designed to reliably withstand high fluid pressures. As the sleeve 50 moves upward, each of the slips 20 is forced further radially outward into biting engagement with the casing, as shown in FIG. 5. While maintaining this high fluid pressure within the assembly 10, a cement slurry may be pumped down the borehole and through the body 12 and the liner, so that the cement slurry exits the bottom of the liner and is then forced back upward in the annulus between the liner and the well bore. During this cement pumping operation, fluid that was in the annulus between the liner and the well bore may easily flow past the set hanger assembly by passing through the recessed areas 22, 24 and 26 formed on the body 12 between the circumferentially spaced slips. Once the cement slurry has been forced upward through the annulus between the casing and the liner and past the assembly 10, the cement pumping operation may be terminated and the cement allowed to set, thereby permanently fixing the position of the liner with respect to the casing. Once the slips 20 have been set as described herein, the pressure within the hanger body 12 may be reduced (even if the liner is not cemented in place) and the set slips will still reliably suspend the second tubular, e.g., the liner, within the well bore. The slip camming surfaces, the static friction between movable components in the hanger assembly, and the axial load on the set hanger assembly are thus generally sufficient to maintain the hanger reliably set in the well bore even though the pistons 36 are thereafter not in forced engagement with the sleeve.

The method of the present invention thus includes forming a hanger body having a central axis, a through bore for communication with the downhole tubular suspended from the hanger body, and a plurality of circumferentially spaced recessed outer surfaces on the hanger body that serve as fluid flow paths exterior of the hanger body for fluid flow between the hanger body and the casing. A plurality of slips are circumferentially positioned on the hanger body, and a plurality of pistons are housed within the hanger body each at a circumferential location substantially aligned with one of the plurality of slips and spaced between a pair of the recesses. A sleeve is structurally interconnected with the hanger body by a shear member, and this shear member is subsequently sheared at a preselected fluid pressure level to allow axial movement of the sleeve with respect to the hanger body. A plurality of piston bores are inclined within the hanger body with respect to the central axis of the hanger body, and each of a plurality of pistons are positioned within a respective one of the inclined piston bores in bore engagement with the sleeve once the shear pin has been severed. As explained above, the radial position of the plurality of recessed outer surfaces on the inner body is controlled such that the radial thickness of the hanger body adjacent each recessed outer surface is less than about 70% of the thickness of a portion of the hanger body circumferentially adjacent a respective slip.

Various modifications may be made to the liner hanger assembly as described above and to the method of setting the liner hanger. Any number of circumferentially spaced pistons may be provided for axially moving the sleeve, although preferably one or more pistons are circumferentially positioned generally in alignment with each of the plurality of slips. While each of the plurality of piston bores within the body of the assembly could theoretically have any cross-sectional configuration, the circular cross-sectional configuration is highly preferred in order to reduce machining cost. Those skilled in the art will appreciate from the above disclosure that two or more, and preferably three or more, circumferentially spaced slips are provided on the hanger body, and that any desired number of pistons may be axially spaced within the hanger body from each of the slips. Accordingly, the desired force for causing outward movement of the slips may be a function of the slip camming angle, the selected number and cross-sectional sealing area of the pistons, and the fluid pressure generated within the hanger body. Also, a fluid isolation member, such as another piston, could be used to separate the pressure face of each piston 36 and the downhole fluids, so that from the pressure side the seals 64 would be exposed to a clean hydraulic fluid rather than a well fluid. Nevertheless, such isolation devices would still result in the piston 36 functionally being in fluid communication with the interior of the hanger body.

If it is known that the liner hanger assembly will be used in an application wherein the liner need not be rotated to properly position the liner with respect to the casing, the guide surfaces on the hanger body that prevent premature radial movement of each slip with respect to the body need not be utilized. Various mechanisms may be provided for structurally interconnecting the axially movable sleeve and each of the plurality of slips. Similarly, various mechanisms may be used for achieving radially outward movement of each of the plurality of slips for biting engagement with the casing in response to axial movement of a sleeve or similar member supported on the hanger body. Those skilled in the art will appreciate that, while the invention has been described in terms of setting a liner hanger assembly within casing for suspending a liner from the casing, the same hanger assembly may be used to structurally interconnect the assembly with various downhole tubular members other than a casing. Similarly, various tubular members other than liners may be suspended from the liner hanger assembly.

Further modifications to the equipment and to the techniques described herein should be apparent from the above description of these preferred embodiments. Although the invention has thus been described in detail for a preferred embodiment, it should be understood that this explanation is for illustration, and that the invention is not limited to the described embodiments. Alternative equipment and operating techniques will thus be apparent to those skilled in the art in view of this disclosure. Modifications are thus contemplated and may be made without departing from the spirit of the invention, which is defined by the claims.

What is claimed is:

1. A liner hanger assembly for suspending in a well bore from a work string to structurally interconnect a first downhole tubular within the well bore and a second downhole tubular generally positioned within the well bore concentrically with respect to the first downhole tubular, the liner hanger assembly comprising:

a hanger body having an upper connector for interconnection with the work string and a lower connector for interconnection with the second downhole tubular, the hanger body having a central axis and a through bore for communication between the well bore above the hanger body and the second downhole tubular, an outer surface of the hanger body defining a plurality of circumferentially spaced recesses for fluid flow between the hanger body and the first downhole tubular, and the hanger body further having the plurality of piston bores each circumferentially spaced about the hanger body;

a plurality of slips circumferentially spaced about the hanger body, each of the plurality of slips having an outer surface for gripping engagement with an internal surface of the first downhole tubular;

a plurality of pistons each housed within a respective one of the plurality of piston bores and movable with respect to the hanger body, each of the plurality of pistons having a fluid pressure face in fluid communication with the through bore in the hanger body; and a sleeve axially movable with respect to the hanger body in response to movement of at least one of the plurality of pistons, the sleeve being interconnected with each of the plurality of slips to cause radially outward movement of each of the plurality of slips in response to axial movement of the sleeve to set the liner hanger assembly in the well bore.

2. The liner hanger assembly as defined in claim 1, wherein:

each of the plurality of piston bores within the hanger body has a generally cylindrical sealing surface; and each of plurality of pistons has a generally circular cross-sectional configuration for sealing engagement with the generally cylindrical sealing surface of a respective piston bore.

3. The liner hanger assembly as defined in claim 1, wherein each of the plurality of pistons has a force transmitting each opposite the fluid pressure face for engagement with a piston engaging surface on the sleeve.

4. The liner hanger assembly as defined in claim 3, wherein each of the plurality of pistons further includes:

a piston seal carried by the piston for sealing engagement with the generally cylindrical sealing surface of a respective piston bore; and a discontinuous outer surface on the piston opposite the fluid pressure face with respect to the seal for maintaining fluid communication between the piston seal and an annulus between the hanger body and the first tubular member.

5. The liner hanger assembly as defined in claim 1, further comprising:

a plurality of carbide buttons mounted on the hanger body and extending radially outward from an outer surface of the hanger body for preventing wear on the hanger body;

the hanger body includes a stop surface for limiting axial movement of the sleeve with respect to the hanger body; and a shear pin interconnecting the sleeve and the hanger body for shearing to allow axial movement of the sleeve with respect to the hanger body in response to a selected fluid pressure within the hanger body.

6. The liner hanger assembly as defined in claim 1, wherein each of the plurality of the piston bores has a piston bore axis inclined with respect to the central axis of the hanger body.

7. The liner hanger assembly as defined in claim 6, wherein the hanger body includes a plurality of fluid passageways for maintaining fluid communication between the through bore within the hanger body and a respective one of the piston bores, each fluid passageway having a passageway axis inclined with respect to the central axis of the body.

8. The liner hanger assembly as defined in claim 1, wherein each of the plurality of the pistons is circumferentially aligned with respective one of each of the plurality of slips and is circumferentially spaced between a pair of the recesses.

9. The liner hanger assembly as defined in claim 1, further comprising:

the plurality of slips each having external teeth for biting engagement with the first tubular; and a plurality of the interconnection members for structurally interconnecting the sleeve and a respective one of the plurality of slips.

10. The liner hanger assembly as defined in claim 1, further comprising:

a pivot member for pivotably connecting a respective one of the plurality of interconnection members with a respective one of the plurality of slips to allow pivoting movement of a respective slip with respect to the corresponding interconnection member.

11. The liner hanger assembly as defined in claim 1, wherein the hanger body further includes guide surfaces for preventing inadvertent radial movement of each of the plurality of slips with respect to the hanger body.

12. The liner hanger assembly as defined in claim 1, wherein each of the plurality of recesses in the hanger body has a radial depth of at least 40% of the thickness of a portion of the hanger body circumferentially adjacent a respective slip.

13. A liner hanger assembly for suspending in a well bore from a work string to structurally interconnect a first downhole tubular within the well bore and a second downhole tubular, the liner hanger assembly comprising:

a unitary body having an upper connector for interconnection with the work string and a lower connector for interconnection with the second downhole tubular, the hanger body having a central axis and a through bore for communication between the well bore above the hanger body and the second downhole tubular, an outer surface of the hanger body defining a plurality of circumferentially spaced recesses for fluid flow between the hanger body and the first downhole tubular, and the hanger body further having the plurality of piston bores each circumferentially spaced about the hanger body between a pair of spaced recesses;

a first slip supported on the hanger body circumferentially between a pair of spaced recesses, the first slip having a first slip surface for gripping engagement with an internal surface of the first downhole tubular;

a second slip support on the hanger body circumferentially between another pair of spaced recesses, the second slip having a second slip surface for gripping engagement with the internal surface of the first downhole tubular, the second slip being circumferentially spaced on the hanger body with respect to the first slip;

a first piston housed within a respective one of the plurality of piston bores and movable with respect to the hanger body, the first piston having a first fluid pressure face in fluid communication with the through bore in the hanger body and circumferentially aligned with the first slip;

a second piston housed within a respective one of the plurality of piston bores and movable with respect to the hanger body, the second piston having a second fluid pressure face in fluid communication with the through bore in a hanger body and circumferentially aligned with the second slip; and a sleeve axially movable with respect to the hanger body in response to movement of the first and second pistons, the sleeve being interconnected with each of the plurality of slips to cause radially outward movement of each of the plurality of slips in response to axial movement of the sleeve to set the liner hanger assembly in the well bore.

14. The liner hanger assembly as defined in claim 13, wherein:

each of the plurality of piston bores within the hanger body has a generally cylindrical sealing surface; and each of plurality of pistons has a generally circular cross-sectional configuration for sealing engagement with the generally cylindrical sealing surface of a respective piston bore.

15. The liner hanger assembly as defined in claim 13, wherein each of the plurality of the piston bores has a piston bore axis inclined with respect to the central axis of the hanger body.

16. The liner hanger assembly as defined in claim 13, wherein each of the plurality of recesses in the hanger body has a radial depth of at least 40% of the thickness of a portion of the hanger body circumferentially adjacent a respective slip.

17. A method of structurally interconnecting a first downhole tubular within a well bore and a second downhole tubular within a well bore, the method comprising:

forming a hanger body having a central axis, a through bore for communication with the second downhole tubular, and a plurality of circumferentially spaced recessed outer surfaces on the hanger body for fluid flow between the hanger body and the first downhole tubular;

positioning a plurality of slips circumferentially about the hanger body;

housing a plurality of pistons within the hanger body each at a circumferential location substantially aligned with one of the plurality of slips and spaced between a pair of the recesses;

suspending the second downhole tubular from the hanger body;

thereafter lowering the hanger body in the well bore to a selected position with respect to the first tubular within the well bore;

thereafter increasing fluid pressure within the hanger body to move each of the plurality of pistons with respect to the hanger body and thereby move each of the plurality of slips radially outward into gripping engagement with the first downhole tubular; and thereafter passing fluid through the hanger body and the second downhole tubular suspended from the hanger body such that downhole fluid is transmitted vertically upward in an annulus between the first and second tubulars and through the plurality of circumferentially spaced recessed outer surfaces on the hanger body.

18. The method as defined in claim 17, further comprising:

structurally interconnecting a sleeve and the hanger body with a shear member;

increasing fluid pressure within the hanger body to a preselected level sufficient to shear the shear member in response to movement of the plurality of pistons; and thereafter further increasing fluid pressure to increase gripping engagement between the plurality of slips and the first downhole tubular.

19. The method as defined in claim 17, further comprising:

inclining each of a plurality of piston bores within the hanger body with respect to a central axis of the hanger body; and positioning each of the plurality of pistons within a respective one of the inclined piston bores.

20. The method as defined in claim 17, further comprising:

controlling the radial position of the plurality of recessed outer surfaces such that a radial thickness of the hanger body adjacent each recessed outer surface is less than 70% of the thickness of a portion of the hanger body circumferentially adjacent a respective slip.

* * * * *